US007264531B2

(12) United States Patent
Asperas

(10) Patent No.: US 7,264,531 B2
(45) Date of Patent: Sep. 4, 2007

(54) METHOD AND APPARATUS FOR FACILITATING THE CONSTRUCTION OF A SNOW MAN/WOMAN

(76) Inventor: Ignacio Marc Asperas, Kirchenstrasse 17E, Munich (DE) 81675

( * ) Notice: Subject to any disclaimer, the term of this patent is extended or adjusted under 35 U.S.C. 154(b) by 211 days.

(21) Appl. No.: 11/045,837

(22) Filed: Jan. 31, 2005

(65) Prior Publication Data

US 2006/0172653 A1 Aug. 3, 2006

(51) Int. Cl.
*A63H 33/00* (2006.01)

(52) U.S. Cl. ..... 446/71; 446/73; 446/76

(58) Field of Classification Search ..... 446/74, 446/73, 76, 70, 71
See application file for complete search history.

(56) References Cited

U.S. PATENT DOCUMENTS 3,059,279 A * 10/1962 Rossi ..... 249/134
4,164,341 A * 8/1979 McComb ..... 249/126
4,351,157 A * 9/1982 Zeigler ..... 62/340
5,380,237 A * 1/1995 Kenyon ..... 446/491
5,485,701 A * 1/1996 Hecht ..... 52/80.1
5,522,181 A * 6/1996 Ellsworth ..... 52/2.15
5,632,926 A * 5/1997 Dyer, Jr. ..... 249/121
5,851,415 A * 12/1998 Thomas ..... 249/117
5,895,304 A * 4/1999 Dixon ..... 446/70
6,135,843 A * 10/2000 Merk et al. ..... 446/70
6,176,464 B1 * 1/2001 Harvey ..... 249/126
7,000,887 B1 * 2/2006 Mulhern ..... 249/157

* cited by examiner

*Primary Examiner*—Eugene Kim
*Assistant Examiner*—Urszula M Cegielnik
(74) *Attorney, Agent, or Firm*—Ignacio Marc Asperas

(57) ABSTRACT

A building component for facilitating a construction of a snow man/woman. A spherically-shaped body is provided that has an outer surface and an interior, the interior substantially lighter than when the interior is filled with snow. An adhesion surface is provided on the outer surface of the spherically-shaped body that substantially increases the ability of the outer surface to adhere snow to the spherically-shaped body. The spherically-shaped body and adhesion surface form a building component for facilitating the construction of the snow man/woman.

19 Claims, 12 Drawing Sheets

Figure 3c
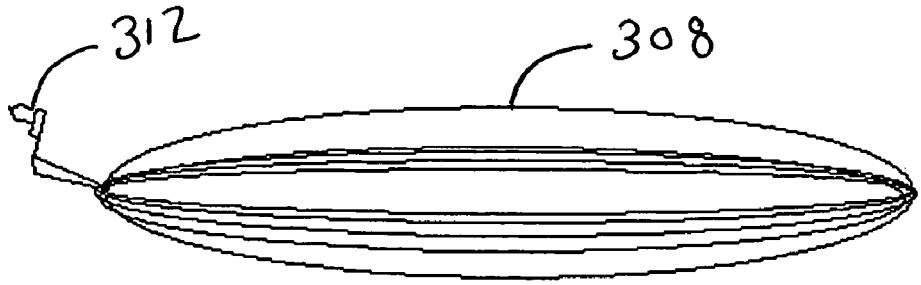
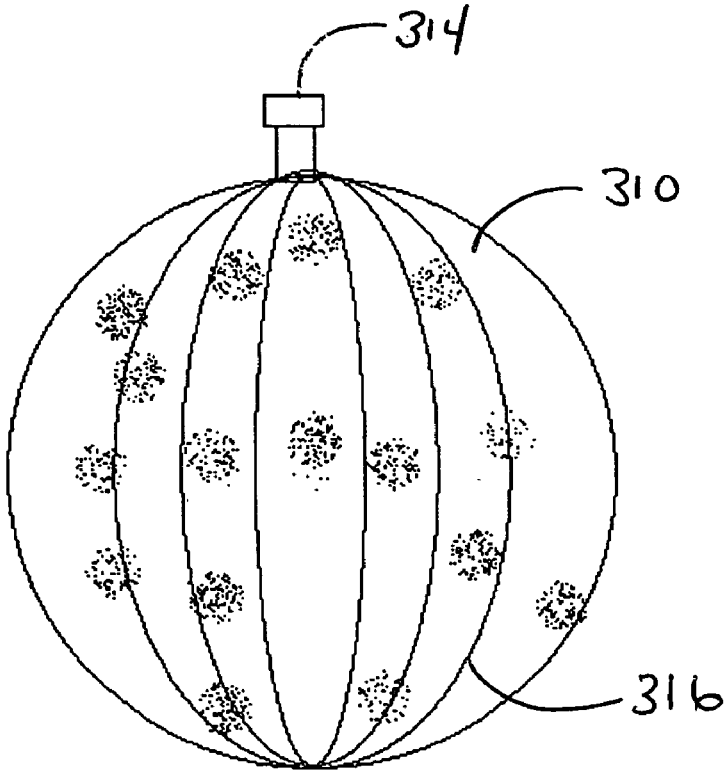
Figure 3d

822

METHOD AND APPARATUS FOR FACILITATING THE CONSTRUCTION OF A SNOW MAN/WOMAN

The following is not a joke patent. Its completely serious and is a serious undertaking to obtain a patent.

BACKGROUND

1. Field of the Invention

The invention relates to a toy or article of construction for constructing or building a Snow Man or Snow Woman.

2. Related Information

History of the Snowman/Woman

The history of the snow man or snow woman is unknown. But, I have to say this. Whoever the first person was to think to form snow into a human figure was a genius. For untold years thereafter, children and adults alike have been thrilled and received joy in making and watching others make snowmen, err women. You know what I mean.

At any rate, what is remarkable is that no one has ever thought, or at least reduced to practice, a way to make snow people easy and fun. I have done an abbreviated patent search and there is nothing relating to the subject of creating a snowman. Unbelievable since it is so much fun and considering the effort involved. But, if no one has thought of it, well, no one has thought of it.

Making a snow man is hard work. As an old pro, I know what a pain in the back it is to roll a snow boulder around a yard. As the snow boulder grows, it gets exponentially difficult. So if you want to make a real big snow man, like me, you wind up breaking your back.

If your like me, you enjoy building snow men . . . big. The bigger the better. One problem is there isn't always someone around to help. It is very difficult by yourself. Over the years, I have developed different tricks to assist my self-style of building snow people. My favourite trick is to use the long end of a shovel as a lever to rotate the boulder when it is really big. With this trick, you can keep rolling the boulder a precious few feet and get the boulder really big.

Another trick I have considered is to start rolling the snow ball on top of a hill or on a slope and work downward as the boulder gets bigger. Even though this works relatively well, it's still hard work to get the boulder to be really big. Besides this, you may wind up with an uncontrollable rolling snow avalanche.

But building a bigger boulder belies an even greater mischief. That is, getting the torso on top. Of course, you want the torso to be proportional to the oversized boulder you have already created, so the torso has to be fairly large as well. Now, the boulder is pretty heavy. Compacted snow is virtually like ice! And you have to lift the darn thing a good four feet. Now this is really back breaking.

Not to mention that now you have to put the head on top. All of this is pretty difficult even for an adult (or big kid) like myself. What is more, I really cannot build a bigger snow man than about my height. The boulder is just too heavy. Just consider how a kid, who would love to build a big snow man/woman, would have no chance without adult help.

I have tinkered with the concept of building a ramp in order to roll the torso boulder on top of the base boulder. I have tried to make a wooden ramp, but the wood proved to be too flimsy to hold the heavy weight. I then considered building the ramp out of snow. But the boulder is just too darn heavy and squooshes the snow down. And building such a ramp requires a lot of time, and snow, which you don't always have.

You never realized there were so many hurdles in building a snow man did you? Well, here is another. Getting the snow man/woman in the precise perfect place. Let's say you want the snow man right in front of the house door. Well, gravity has a lot to say about that. If your house, like most houses are built up to provide drainage, it becomes a serious physical effort, as well as logistical challenge, to roll the boulder to the right spot.

Another thing has always bothered me when I have built snow people. You can never make a perfect snow man. The snow balls are never, and I mean never, perfectly round. They are always lop-sided and look sort of doofy.

There is a construction problem, as well, related to the non-uniformity of the snow balls. Namely, it is difficult, particularly with large snow men, to balance another snow ball or boulder on top without it toppling over. To make matters worse, the third ball or boulder on top is made even more difficult to balance on a bust that is already tipsy.

Another problem in the art is that there is often not enough snow. With the first snow fall of the winter, ushers into each of us elatement and joy of running outside and playing in the snow. Unfortunately, all of this enthusiasm is lost on a lack of snow. The first snow fall usually never sticks. We can also drag in global warming here as a culprit for seemingly declining snow levels. But this patent attorney won't reach that far. The point is, wouldn't it be great if we could build a snow man of decent size with relatively less or little snow fall.

Lastly but not leastly, one must consider that the snow person is subjected to warmer temperatures and will melt. It will settle as the weight of its own snow compacts in on itself and deform, possible falling over. Adornments placed on the snow man will tend to loosen and fall out. Happy smiles fade into frowns. Eyes get droopy. Wind will blow away hats, scarves and other accoutrements. Finally, there is terminality. You have to do all of that back breaking work again if a warm snap comes by and melts your snow man.

Of course, all of the problems of making snow men/women is part of what makes it fun. Getting a whole group of people around and working together. Being outside in the snow for hours. And, yes, having a doofy lop-sided snow man does have some charm. And, even if you don't have enough snow, who cares anyway.

That may be true. But we are living in the 21$^{st}$ century now. We have created the Internet. China is getting ready to send a person to the moon. And we invented silly putty, perhaps one of the all-time greatest inventions a big kid ever invented. Can't somebody build a better snow man?

So then the flash of genius strikes me. What if? What if someone could make a snow boulder that was light weight. So light, it could be easily handled so that it could be made really big and still be easily moved, or even carried, even by a youngster. A snow boulder light enough to be easily placed on top of another boulder. Or light enough even to be easily positioned in that perfect place in your yard?

What if someone could make a snow boulder that was perfectly symmetrical, so that it could easily balance on top of another similar boulder. A symmetrical boulder that could form a perfect looking snow man? How cool would that look in front of your house during the holidays?

What if someone could make a snow boulder that is perfect every time. A snow man that could be replicated so that it looks the same each time, each year. Or rebuilt from the old snow man/woman in a matter of moments.

What if someone could make that out of a light weight, abundant material that is cheap and is practically used in all toys?

What if a really big snow man could be built utilizing the bare minimum of snow?

What if?

Today is that day.

SUMMARY AND OBJECTS OF THE INVENTION

It is said that the most ingenius ideas are the most simple in design. The Wheel. The Toaster oven. And, yes, now the ultimate Snow Man. Of course, in hindsight the wheel is not so inventive, but at the time it was an earth-shattering innovation. I do not pretend that the ultimate Snow Man will be as revolutionary to the advancement of mankind, but I do contend that as far as I know no one has ever conceived and reduced to practice such an apparatus. I do contend, however, that my innovation is a heck more fun, err than a plain old wheel, and will inspire tons of enjoyment and play for hopefully a long time.

The fundamental building "block", or component, of the invention is the creation, for the first time, of a snow sphere that is much lighter in weight than a snow ball or boulder of the same size made out of snow. The snow sphere is made of a material that is rigid enough to support a layer of snow, yet made of a material or construction that causes the snow sphere to be much lighter in weight than a snow boulder of similar size.

The Snow Sphere preferably includes a snow adherent surface that is amenable to bearing and holding snow particularly for varying conditions of snow from dry to wet.

In one aspect, the interior of the snow sphere, thus encased in a layer or sheath of snow, is hollow or substantially hollow. For this reason, it is much lighter and, thus, much easier to handle than a snow boulder of the same size comprised entirely of snow.

Further, given the spherical shape of the Snow Sphere, the snow formed on the adhesive surface forms a shell that reinforces and, indeed, provides its own support and rigidity. In another aspect, or in combination therewith, the Snow Sphere includes supporting structure on the inside, such as spokes, ribs or Styrofoam.

The invention further encompasses the construction or assembly of such spheres, a number of such snow spheres as well as the assembly of such spheres. There is also provided a manner to adjoin the boulders together. There are also attachments and means for attachment for the invention for body members or decorative objects.

From the above, it shall be appreciated that the present invention provides an elegant solution to the age old problem of snow man/woman building technology. Using the present invention, one can much more easily manipulate one or more of the Snow Spheres in order to roll, position and assemble a snow man/woman. Certainly, this provides an enormous advantage over the prior method of hefting large, snow compacted, boulders atop another. Kids all over the world will be able to easily and quickly build snow men/women adding immensely to the enjoyment and fun of the art.

Because the invention forms near perfect spheres, there is also the advantage that beautiful well dimensioned and proportional snow people can be built. Usually, only lopsided and imperfect snow people could be achieved in the past. Snow men/women perfectly formed may also be appealing for business displays or holiday decoration in front of official buildings. However, we shall leave the business method aspect of this invention for the next patent application.

BRIEF DESCRIPTION OF THE DRAWINGS

FIGS. 3*c-d* illustrate a variant of the invention;

DETAILED DESCRIPTION OF THE PREFERRED EMBODIMENTS

Figure 1:
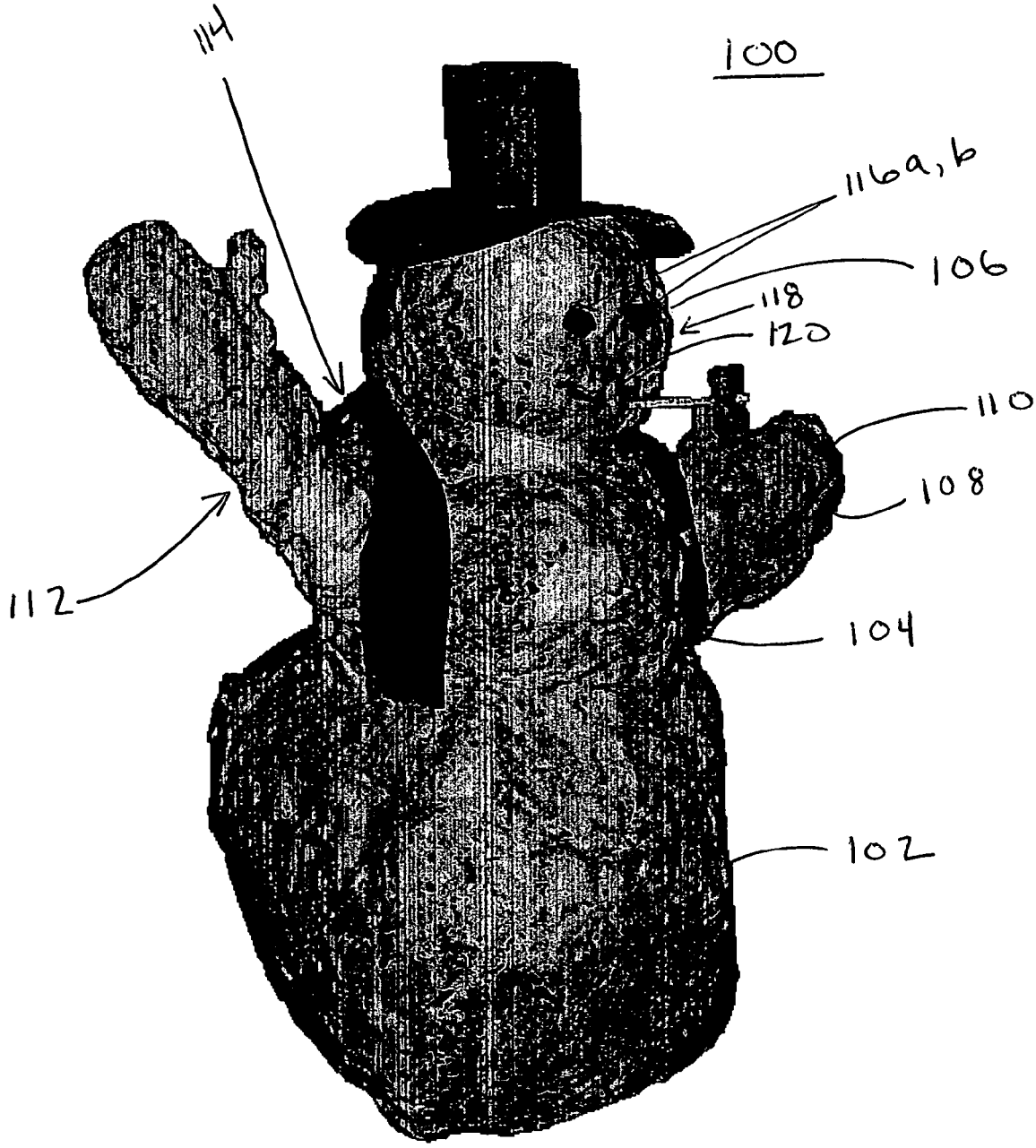
FIG. 1 illustrates a snow man.

To gain a better appreciation of the task at hand, we turn our attention to FIG. 1 which illustrates the good old fashioned snow man 100. But I shouldn't say its good old fashioned, because I used some proprietary techniques to build it. Before we go there, however, let's examine this snow man in more detail.

I made this snow man all by myself. It stands about 6 feet high without the hat and comprises three snow boulders 102, which we shall call the trunk, or base, 104 the torso and the head 106. There are also arms 108, a feature I am somewhat proud of. Notice the realistic mitten shape 110 of the gloves. Although it is arguable that kids across the globe make arms out of twigs, icicles or even branches encased in snow, I think one can say that I have advanced the art here. I received a lot of compliments on my snow man. For all that, there are problems.

First of all, you will notice that our snow man, which I shall refer to as Frosty, has quiet a large caboose 112 on his trunk 102. In less politically correct terms, his behind is quite large. This is the result of not being able to roll the snow ball evenly. In fact, to obtain such a spherical shape is quite impossible. As the snow boulder grows in size, it tends to form unevenly. I believe this is due, in part, to the varying density of the snow on the ground.

The same can be seen with smaller boulders, such as the torso 104. Here, Frosty apparently seems to be suffering from Hunchback of Notre Dame Syndrome 106. What hump? I suppose these irregularities could be eliminated if one were so careful to roll the ball perfectly in every direction. However, that would require perfect and uniform snow conditions. At any rate, it would take ages to adjust the boulder as it rolls to the perfect side so that the ball is nice and spherical. Not fun.

I know what you are thinking. Why not just lop off the uneven portions. I tried this. It's not so easy on compacted snow. Also, it changes the balance of the snow man. If you lop off a large section, you seriously jeopardize the balance of the snow man. In doing so, you could knock your snow man right over. Particularly as the snow melts, the snow man will slump to one side, again possibly falling over.

On the positive side, the arms in FIG. 1 illustrate just how creative one can get with a snow man like Frosty (or snow woman, which we will later refer to as Angel). I am quite proud of these arms. My secret is to pre-place holes in the side of the torso 104 using a branch or, in the instant case, a long board. Then, I remove the board and compact snow around the board to form a snow arm. I then mold snow hands in the shape of mittens. I leave a little extra of the board sticking out that will be placed in the pre-pared slot.

I then build up snow shoulders, not only for aesthetic appeal and anatomical correctness, but also for support of the arm. One must consider longevity. Frosty will melt and the arms will sag if left unsupported. I also try to support the weight of the snow arms by shoving the board as far down into the trunk 102 as far as possible. Thereby gaining leverage and support from the trunk 102 and lowering the center of gravity of the arms.

As great as these arms are, however, there are several problems with my previous constructions. First, you will notice that the shoulders can never be in the anatomically correct position. Instead, they are formed at a middle point 112 of the torso 104. This is apparently due to the fact that the torso 104 cannot support the heavy weight of such snow arms at a relatively higher load, say at point 114. It looks stupid.

There is another fault here that needs to be pointed out. Normally, the arms must be placed on either side of the snow person at relatively opposite positions. This is due to the fact that the uneven placement of the snow arms at different corresponding positions causes the torso to tilt, particularly as the snow man melts and loses cohesion.

Another problem is apparent from this figure. Frosty appears to have measles. A really bad case. These are actually crab apples that stuck to the snow boulders as they rolled. Apparently, the larger the boulder, the more it's weight presses down and compacts the snow as it rolls. With extremely heavy boulders like this one, and given light snow conditions, the weight compacts the snow enough to pick up bits of earth, grass, and yes crab apples.

A final word here is due on Frosty's features. He has two eyes 116 *a, b* (not coal) and a mouth 118 made out of some stones. One particular problem, on such a warm day as it was, was that the stones kept falling out. Cold stones seem to have terrible adhesion with snow. You can see here that Frosty is missing his two front teeth 120.

Further, Frosty sports some additional props, a top hat 122, a scarf 124 and a pipe 126. As any kid can tell you, the problem is that a good wind will blow that hat 122 right off. The scarf 124 is more resistant to being blown off by the wind, but it definitely did flop over to one side and had to be re-positioned later. The pipe 126 seems to be quite secure as it has a long distal end that is shoved into Frosty's mouth. We want to ensure Frosty's lip cancer. But, in actuality the pipe 126 kept falling out as the snow melted. Frosty new better.

Needless to say, despite the fact that it is January it has warmed up since then and Frosty is now "awl melty" and "gawwn". Gee whiz. Even though this snow man only took me 2 hours, it was tiring and exhausting work even for an expert like myself. Now I have to start all over again.

Enter the ultimate Snow Man. The present invention provides a unique manner in which to build or construct a snow man or woman and a method therefore.

More particularly, there is provided the building blocks and method to provide and assemble the building blocks for creating the ideal snow man/woman. What is invented is the ability to create snow boulders that are light weight and, therefore, more easily handled and lifted atop other such boulders. With this invention, the ideal snow man/woman can be created anywhere, with much less effort than before and without long hours in the cold.

In this invention, a snow man or woman may be as little as two snow balls or boulders. Of course the traditional number of snow boulders for a snow person is three, and naturally the invention encompasses three boulders. That said, the invention encompasses more than three snow boulders. At any rate, we shall focus here on the fundamental building block of the invention, a single snow sphere. Such a snow sphere could be utilized, for example, as a torso or head on top of a normal snow boulder.

Figure 2A:
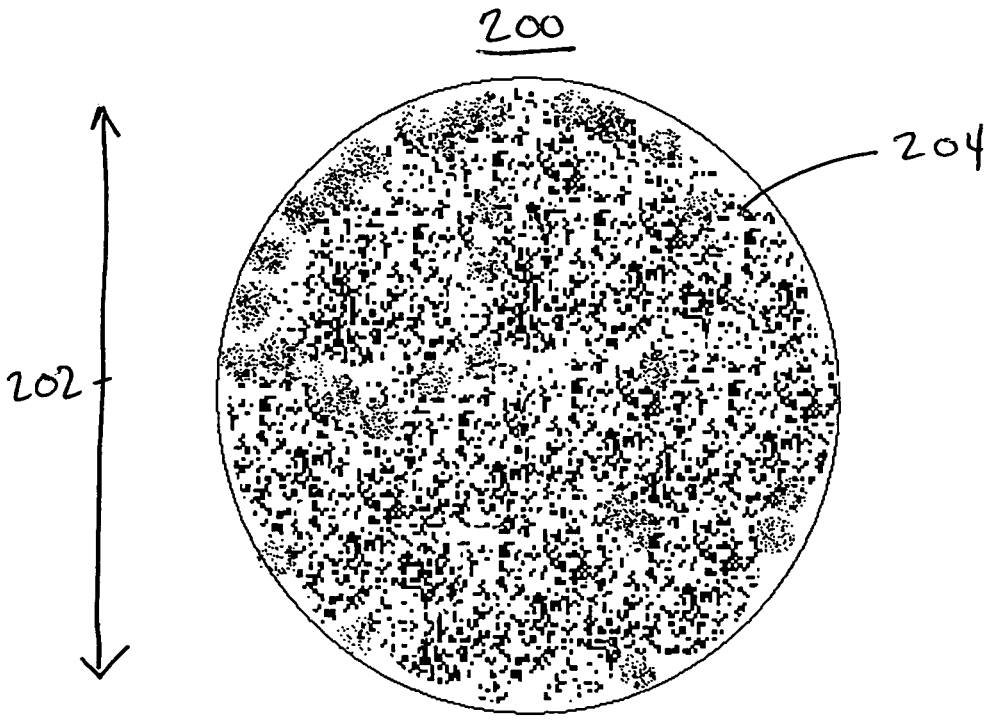
FIG. 2*a* illustrate the present invention.

FIG. 2*a* shows the fundamental building block of the invention, the Snow Sphere 200. The Snow Sphere 200 is a sphere or sphere like shape generally in shape of a sphere. Naturally, the snow sphere is sphere shaped so that it may be rolled easily in any direction, thereby attaining the ideal spherical snow boulder. The spherical shape also provides the builder with ease of maneuverability and handling of the snow boulder.

The dimensions of the Snow Sphere shall not be limiting of the invention. That is, the Snow Sphere may be of any size. However, in one aspect of the invention, the snow sphere or spheres are proportional to the size of the size of a normal man, woman or child which they emulate. In other words, a diameter 202 for trunk snow sphere in this aspect for an adult snow person would be the height of a normal adult up to the area of the hips. A child trunk would be proportionally smaller, naturally. Similarly, the torso diameter for an adult is about the same length of a torso of a normal adult. Of course, the range of sizes varies with the variety and range of human sizes.

The Head is another matter. While the head may be of any size, it is typically in proportion with the trunk and torso. See for example FIG. 1. In this variant, therefore, the diameter of the head snow sphere is proportional to the other snow sphere or spheres. Again, the head, torso and trunk may be of any size. For example, it is an advantage of the invention to create larger than life snow men/women and, therefore, the proportions of the invention may be larger than normal.

FIG. 2*a* also illustrates another variant of the invention. The adhesive surface 204. The function of the adhesive surface is to provide a grippable region where snow can more easily clump and form within the pockets between elements forming the adhesive surface. Test trials have been performed and have proven that it is much easier to apply the snow to the Snow Sphere 200 with the adhesive surface than to a sphere with smooth surface. In the latter case, the snow tends to slide off one side of the smooth sphere, particularly when rolled.

In contrast, the adhesive surface holds clumps of snow in place on the Snow Sphere whilst the builder scoops up more snow and applies another clump to another region. The adhesion surface is designed to include a substantially higher friction coefficient than a smooth surface, that is sufficient to grip or hold snow thereon.

Once the Snow Sphere 200 is encased in a layer of snow, the builder simply rolls the sphere on the snow to build up more snow on the Snow Sphere. The snow on the Snow Sphere has proven to grip well with snow on the ground. Because the Snow Sphere is large to begin with, it is already quite sizeable with this first layer of snow manually applied by the user. With the added weight of the first layer of snow, the Snow Sphere has proven to be able to have enough weight to compact snow underneath it as it rolls and collect even more snow. Of course, the Snow Sphere itself is much lighter than it would have been if it were composed entirely of snow.

The adhesive surface has another function. As the snow melts, it tends to slide off an adhesion surface less readily than a smooth surface. This allows the ultimate Snow Man to last longer and require less maintenance.

The snow sphere in one variant is white in order to hide any lapses in snow. This is particularly useful when the snow melts, leaving behind patches of the snow sphere surface exposed. In another variant the snow sphere is colored, such as red or orange, in order to highlight places to the builder which require more snow. A black surface has also been experimented with. It appears that the black surface warms quicker in the sun which tends to be better for gripping dry snow. Evidently, the warm surface of the snow sphere melts the first layers of snow it comes into contact with, providing the crucial dampness needed for snow clumping.

Figure 2B:
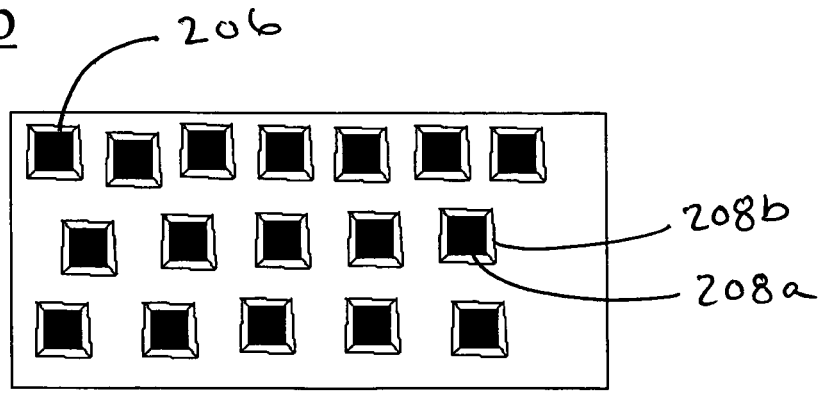
FIGS. 2*b-c* illustrate an adhesion surface of the present invention.
Figure 2C:
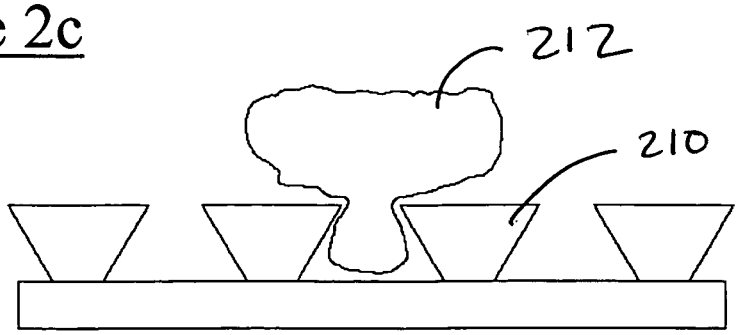

FIG. 2*b* illustrates a variant of the adhesive surface. Here the adhesive surface is comprised of nodules 206. Here the nodules are shown as trapezoidal shaped protrusions, or studs, extending from the surface of the snow. In one variant, the protrusions have a top surface 208*a* that is smaller than its base surface 208*b*. This is easier for molding the snow sphere. However, the invention also encompasses the surface area of the top of the nodules to be larger than the base (reference numeral 210), thereby trapping the snow 212 like pores in between the open areas near the base of the nodules as shown in FIG. 2*c*.

Other materials or textures are also suitable for use as the adhesion surface. These other textures may have varying degrees of grip to the snow dependent on the type of snow. For example, the large nodules have proven to be not as effective for dry snow. A sand paper adhesion surface has been experimented with and it appears that the smaller nodules of the gritty sand paper are slightly better for relatively dry snow.

Other shapes for the nodules are within the scope of the invention as well. For example, in order to prevent injury to children, the nodules may be in the form of bumps. Depressions, such as round or square-peg holes may also be applied. Golf ball dimples could also be used. In that case, the depression of the dimples provide the area where the snow is compressed and sticks to the surface of the Snow Sphere. The nodules may be, for example, replaced by holes bored through the shell of the snow sphere itself.

The nodules, studs or depression do not necessarily have to be uniformly spaced. Although, this would tend to add to the uniformity of the snow layer stuck to the outer surface of the snow sphere. In addition, it would be easier for a plastic mold to be constructed with evenly spaced depressions for the nodules.

Figure 3A:
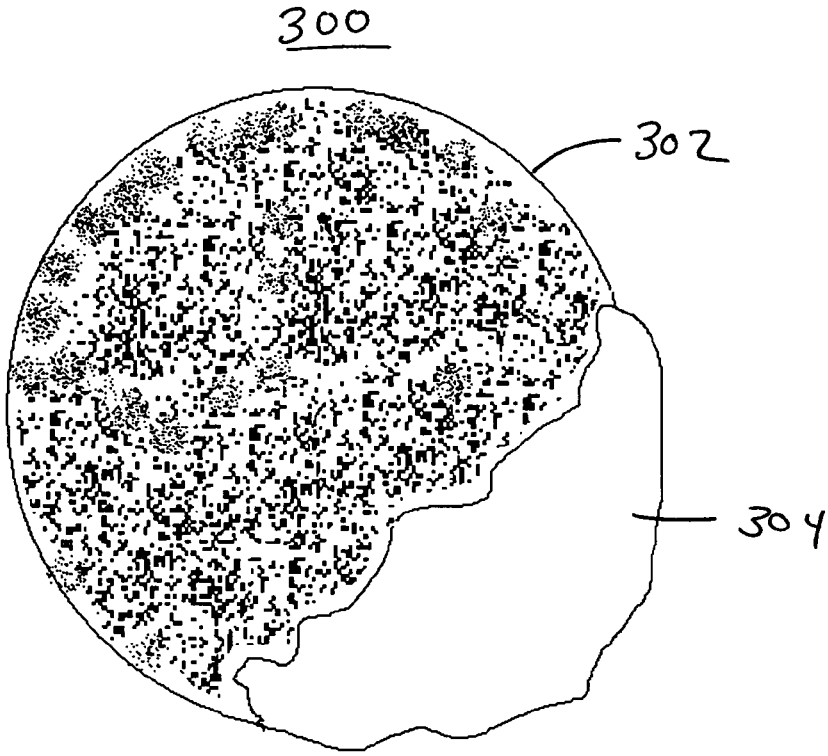
FIGS. 3*a-b* illustrate the invention in operation

The clumping effect of the adhesion surface 302 of the snow sphere 300 is illustrated in FIG. 3*a*. Here, there is shown snow 304 manually stuck to a portion of the snow sphere. As explained before, the adhesion surface holds the snow 304 in place, making it easier for the builder to add more clumps of snow. Of course, the adhesion surface keeps the snow adhered to the surface of the snow sphere while it is being rolled or in its stationary position.

Figure 3B:
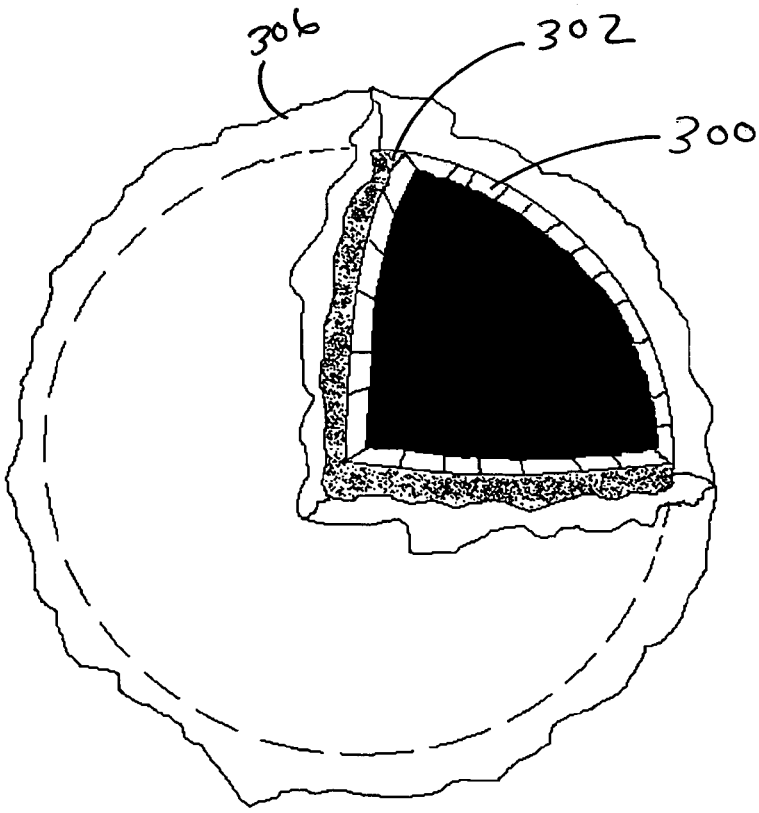

A phantom view of the snow sphere 300 that is completely covered in a first layer of snow or sheath 306 is shown in FIG. 3*b*. Except for the phantom portion removed for purposes of illustration, the snow sphere of the present invention is completely covered in snow. From this figure, it will be clear the massive savings of weight that is attained with the present invention. The snow is only on the outer surface and the entire inside of the snow sphere is hollow, substantially hollow, or made of a material that is of much less weight than compacted snow.

The result is a large snow boulder that is much lighter than a boulder of the same size. The resulting snow boulder of the present invention is, therefore, more easily manipulated and hefted than its primitive predecessor. It also has the advantage that it can be made even larger than normal, since it can be rolled much more easily than a boulder of the same size entirely made of snow.

FIG. 3*b* also illustrates a structural feature of the invention. The sphere or sphere-like shape is imparted to the snow covering the snow sphere. A physical characteristic of a sphere shape is that any point on the sphere is supported through adjacent points to all portions of the sphere. Thus, the snow itself obtains strength and supports itself once it is applied sufficiently to the surface of the snow sphere.

It should also be apparent from the figures that the show sphere is intended to be a unitary work piece. That is, it is not intended to be manufactured or sold as a composition of other pieces. That is, the snow sphere is, without first being rolled or covered in snow and placed on top of another snow sphere, free and unconnected from other work pieces. Of course, the snow sphere may be comprised of portions, such as hemispheres, but it is contemplated that the portions placed together form the unitary work piece. Later, a mechanism for adjoining the sphere to another sphere is contemplated, but this is added for the purpose of adjoining the snow spheres after they are rolled, or covered, in snow.

Now we turn to the composition of the snow sphere. The snow sphere may be constructed out of any material that is suitable for holding its shape under the weight of the first layer of snow. On the other hand, the material need not be so rigid or thick as the snow itself will form the supporting structure once the snow sphere get rolling. While this is not an exhaustive list, the show sphere may be, for example, made out of plastic, graphite or any other composite, fibreglass, aluminium or any other metal. As long as the material is strong enough to support the snow sphere structure and the first snow layer, the material is acceptable.

Another possibility, shown in FIGS. 3*c* and 3*d*, is that the snow sphere is a blow up sphere or beach ball with the adhering bearing surface. Shown in the FIG. 3*c* is the balloon 308 relatively deflated and the snow sphere balloon 310 inflated. The balloon may be blown up through a mouth piece 312 or inflating valve 314 opening that may be closed with a plug or valve cover as is well known in the art of blow toys.

A blow up snow sphere has the advantage that the owner can store the snow sphere easily. It also makes stocking of the item and display in stores much easier. Also, the compressed air inside the balloon snow sphere adds to the support of the structure. The balloon is also much lighter in weight. The main concept is the same. The builder applies the snow clumps to the adhesive surface 316 and then rolls the snow sphere to create a large snow boulder that is lighter in weight than a normal snow boulder.

Figure 4A:
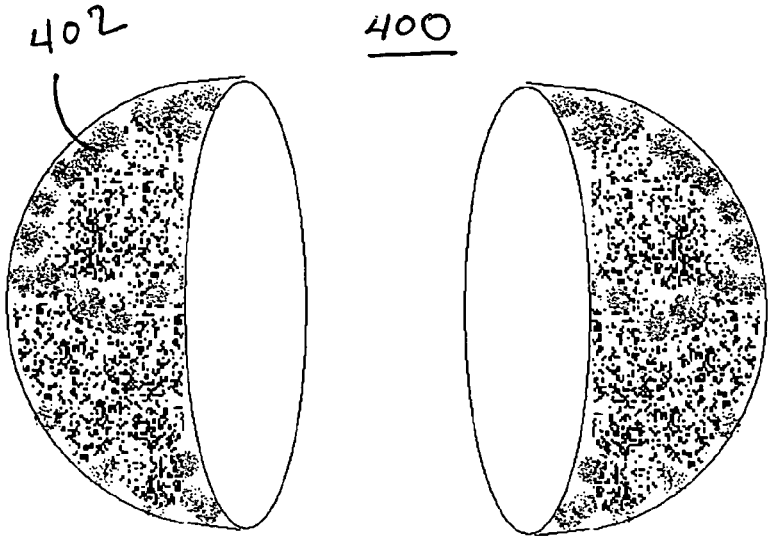
FIGS. 4*a-c* illustrate an interior of the invention
Figure 4B:
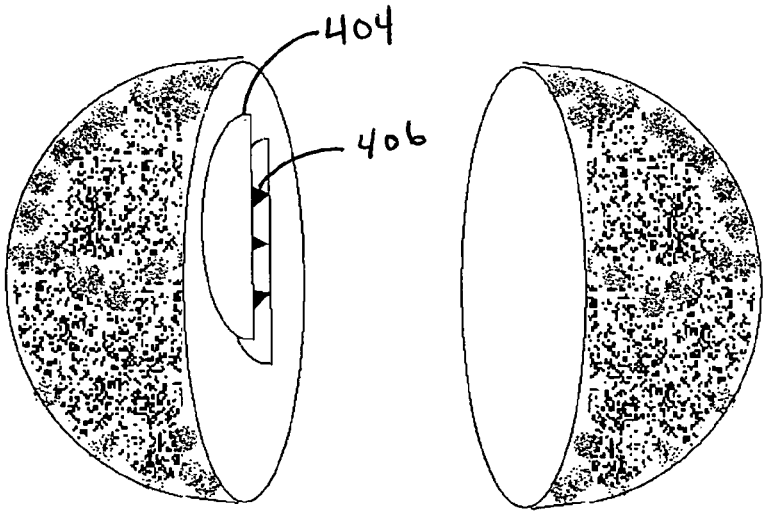
Figure 4C:
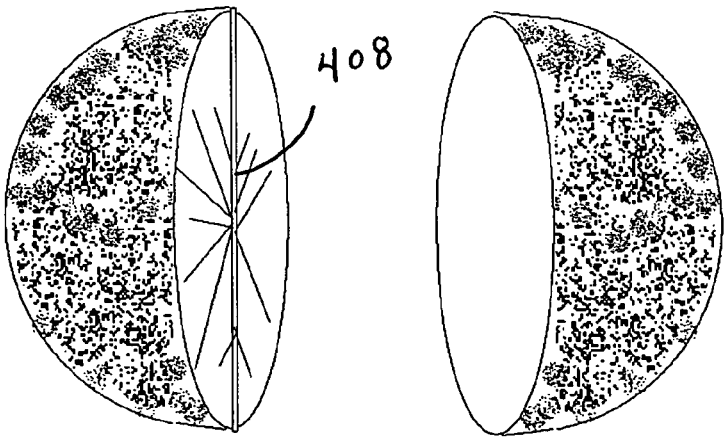

FIGS. 4*a*-4*c* illustrate the internal structure of the snow sphere 400. The adhesion surface 402 is also shown on the outer surface of the snow sphere 400. FIG. 4*a* illustrates that the interior of the snow sphere 400 may be hollow. It may also be made of a material that is light weight yet adds support and strength to the snow sphere, such as styrofoam, graphite, or other known light weight materials. The light weight materials may either fill the interior or be arranged to leave spaces, such as in a baffled, corrugated or matrixed arrangement.

One technical aspect of building a snow man/woman that needs to be mentioned here is that it is helpful that the snow boulder be of sufficient weight in order to compress the snow beneath. This causes the snow to partially melt and bond with the adhesion surface or snow bearing on the adhesion surface in a process called snow sintering. In that case, it is helpful if the interior of the snow sphere is filled with a light weight material that is substantially lighter than compacted snow, yet has sufficient weight to act as a ballast material to cause the snow boulder to compress the snow beneath sufficiently to cause snow sintering. However, this is merely a variant of the invention and the invention performs sufficiently well without such a ballast particularly when the snow sphere is comprised of a material that is sufficiently hefty, such as plastic. Also, when the snow sphere is covered in snow, the snow itself acts as a ballast and additional ballast may not be required.

FIG. 4*b* illustrates a variation of the invention, wherein the interior is formed by ribs or baffles 404 that contact or are fixed to an interior surface of the snow sphere. The ribs may include cross ribs 406 for added strength. The idea of the ribs is to add strength to the snow sphere, yet leave open spaces of air or light weight material, in order that the overall weight of the snow sphere is significantly less than a snow boulder of similar size. The ribs may or may not be uniform and may be of the same material as the outer snow sphere shell.

FIG. 4*c* illustrates yet another variant of the interior of the snow sphere. Here, the interior is arranged with spokes. The spokes, similar to the ribs, provide added support and strength to the structure of the snow sphere. The spokes may be one or more elongated rods that span any arc inside the snow sphere and are fixedly connected to the interior surface of the snow sphere at distal ends of the rod. The spokes may also be connected at intermediary points along the rod, such as spokes on a bicycle wheel. The spoke may be uniformly spaced, or non-uniformly spaced. Of course, in the case of spokes, it is preferable that the spokes are uniformly spaced in order to ensure that the strength of the structure is uniform at generally every point on the outer surface of the snow sphere.

Figure 5A:
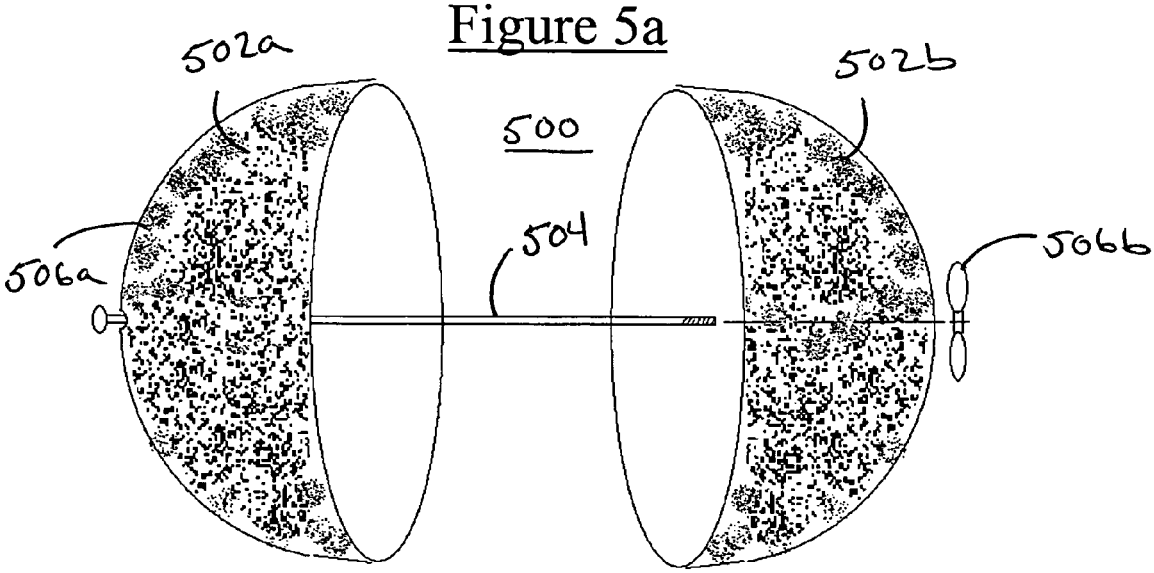
FIGS. 5*a-b* illustrate a connection mechanism of the invention.
Figure 5B:
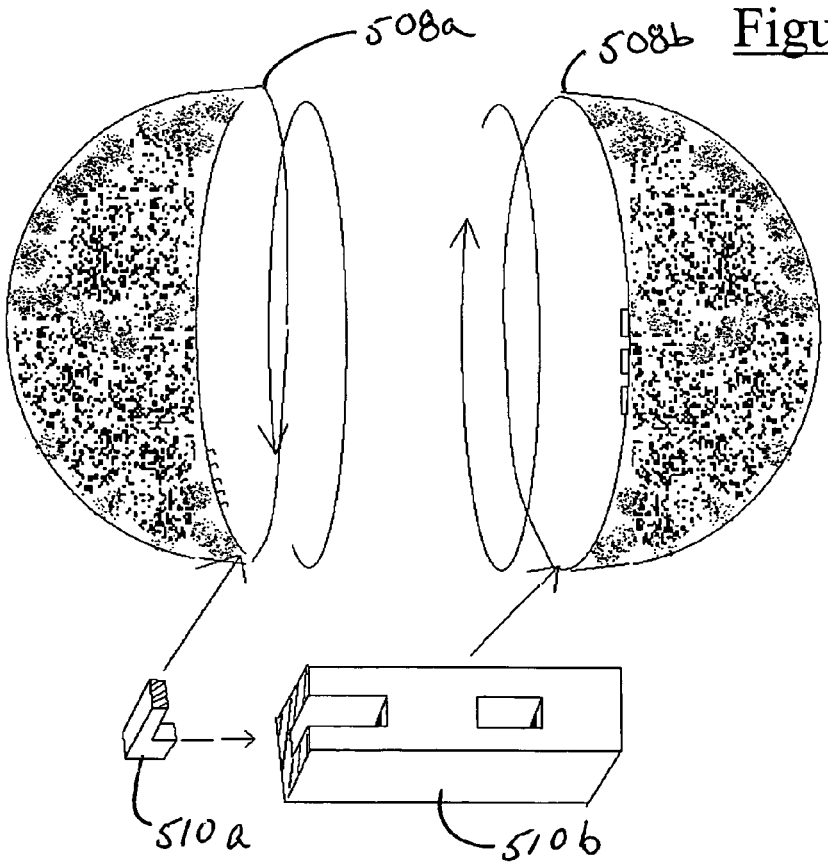

FIGS. 5*a* and 5*b* illustrate a variant of the snow sphere 500. For ease of production, storage and stocking, the snow sphere may be produced and sold in one or more portions. Here, there is shown that the snow sphere is provided in two half or hemi-spheres 502 *a, b*. In this case, it is also within the invention to create one hemisphere slightly smaller, so that it fits within the concavity or cavity of the other sphere. With this arrangement, the snow sphere hemispheres may be stored or stocked by placing one hemisphere inside the other, thereby greatly reducing space required for storage of the snow sphere. It also makes transport from the store easier.

At any rate, if the snow sphere is arranged in portions, then there should be provided a manner in which to connect the hemispheres. In FIG. 5*a*, a connection scheme is shown in which there is provided by the invention a rod or rods that fasten each hemisphere to each other. In its simplest form, the rod may be inserted through distal ends of the snow sphere and fixed at both ends in order to cinch the two halves together. In one embodiment, there may be a stopper at one end to hold one hemisphere against the other and a nut, or wing nut, threaded on threads formed on the other end. When the wing nut is tightened, providing that the rod is slightly large than an outer diameter of the snow sphere, the wing nut eventually bears on the outer surface of the snow sphere drawing the other end of the rod toward the wing nut end. When the stopper, which should be larger than a hole in the end of the hemisphere, bears against its side, the stopper causes the other hemisphere to bear against the opposing hemisphere. Thus, the two halves are brought together at their circumferences into close engagement and forming a single snow sphere. In one variant, the rod may be provided with one or more opposing threads at either end and threaded mates inside the interior of the snow sphere, whereby the hemispheres are fixed together by screwing the threaded end or ends into the mating socket inside the opposing hemisphere.

FIG. 5*b* illustrates a variant in fixing the hemisphere together in that mating edges 508 *a, b* are provide on the lip of the bearing circumference of each hemisphere. In one aspect, the mating edges may be lock type edges, shown here as L-shaped hooks 510 *a* and mating sockets 510 *b*. The hemispheres are brought together so that the mating surfaces are in close engagement and the L-shaped hooks are bearing into open regions in the opposed mating edge. The hemispheres are counter rotated with respect to each, thereby sliding the L-shaped hooks into the recesses of the opposed mating edge, thereby locking the hemispheres into place. Of course, any type of mating edge, including mating edges that snap together, may be used in the present invention.

The invention also encompasses a number of snow spheres arranged to facilitate the construction of a snow man/woman. Normally, the invention works well simply by stacking the snow spheres covered with snow atop one another. The lighter weight allows one or more people to heft the torso onto the trunk snow sphere. The builder may also flatten or make a depression in the top of the trunk snow sphere in order to provide a platform for the torso snow sphere to rest.

Figure 6A:
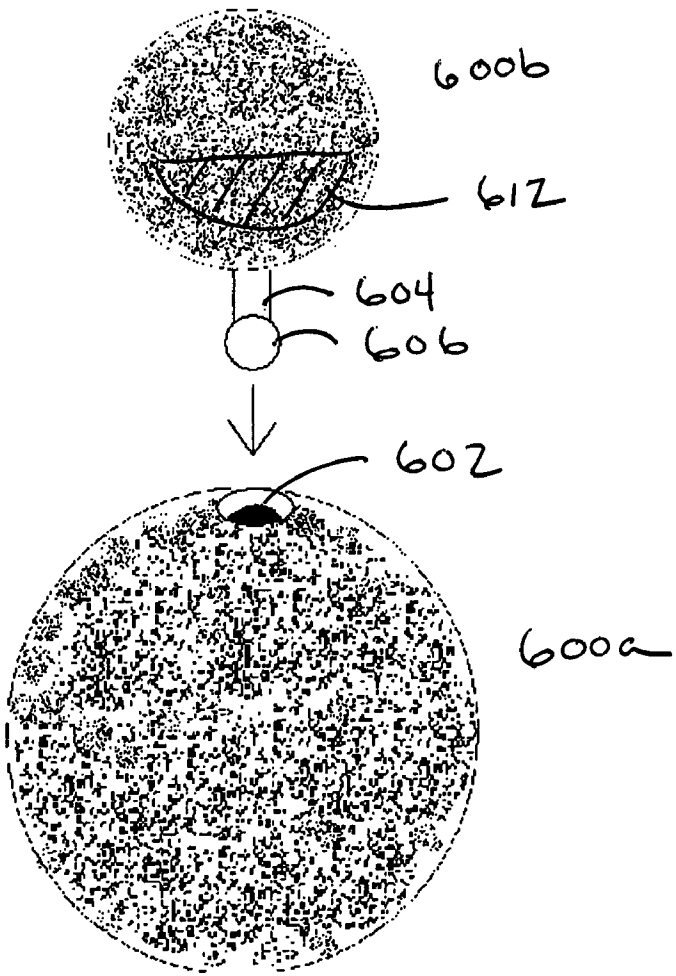
FIGS. 6*a-b* illustrate adjoining components of the invention
Figure 6B:
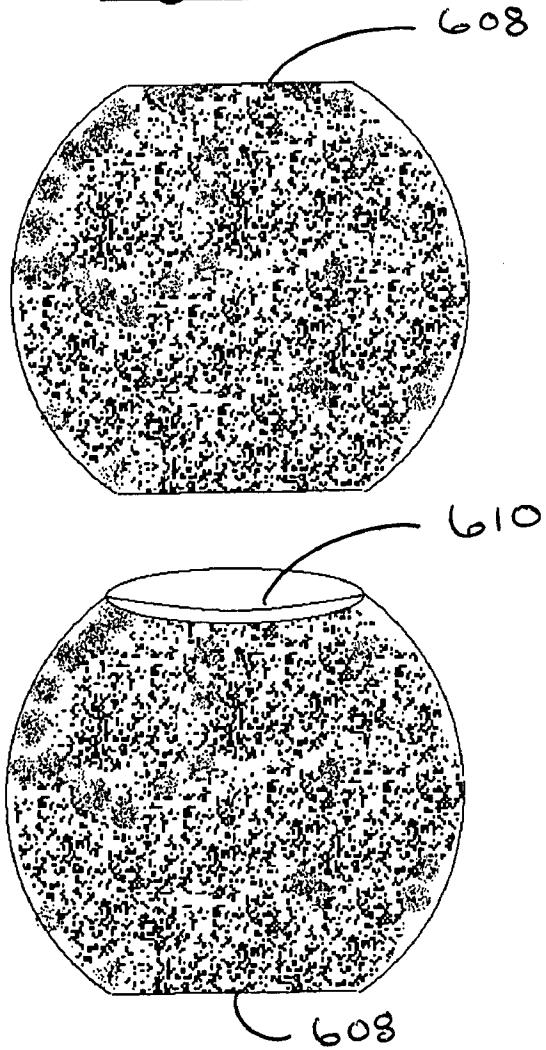

FIG. 6*a* illustrates a variant of the invention how the snow spheres 600*a, b* of the present invention may be adjoined. In this variant, there is provided in one of the spheres a hole 602 that is dimensioned to receive a protruding portion 604 that is connected to sphere 600*b*. The protrusion 604 may include a locking ball 606 that is slightly larger than the diameter of the hole 602, such that when the protrusion is inserted into the hole the sphere 600*b* is locked into the sphere 600*a*. FIG. 6*b* illustrates another variant of the adjoining mechanism. Here, the sphere may include a flat surface 608 or a depression 610. The flat surface or depression facilitates balancing the snow boulders atop each other.

Another variant illustrated by FIG. 6*a* is that the snow sphere may include feature indentations. Here, there is shown a mouth cavity already placed in the snow sphere. When the snow sphere is formed with snow, the mouth cavity will form the shape of an open mouth, thereby facilitating later forming the mouth. Other feature indentations are within the scope of the invention.

Figure 7B:
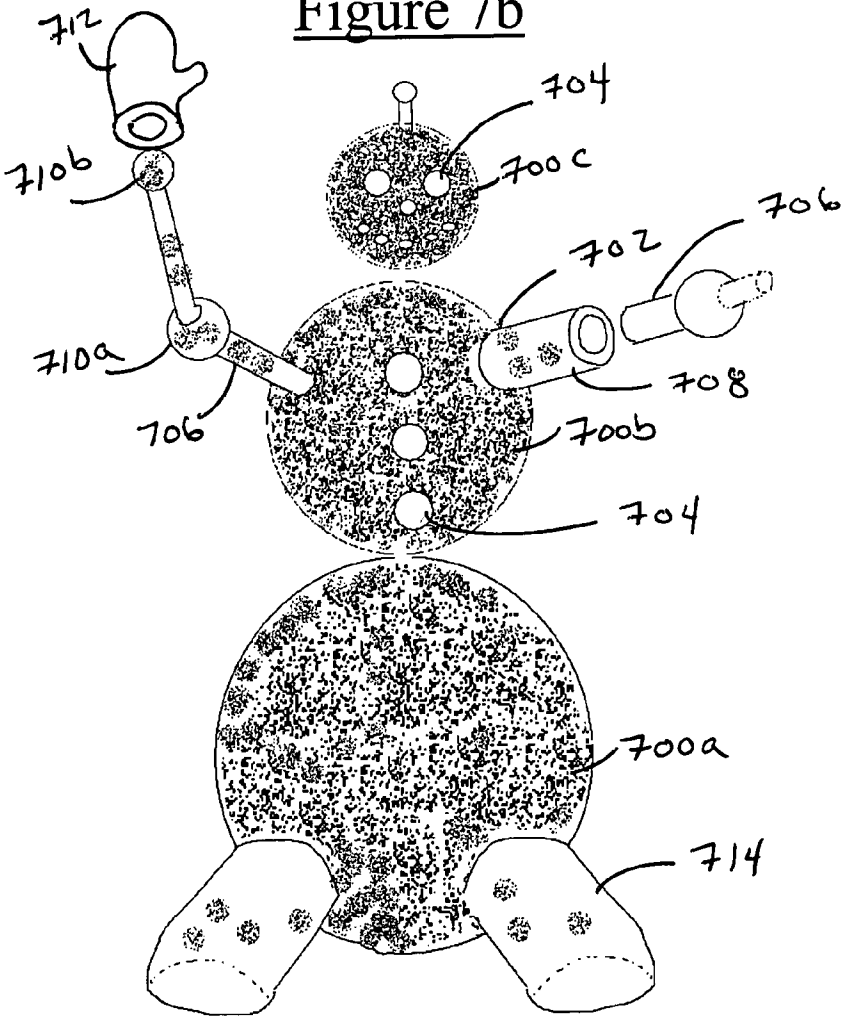
FIGS. 7*a-b* illustrate compositions of the invention.
Figure 7A:
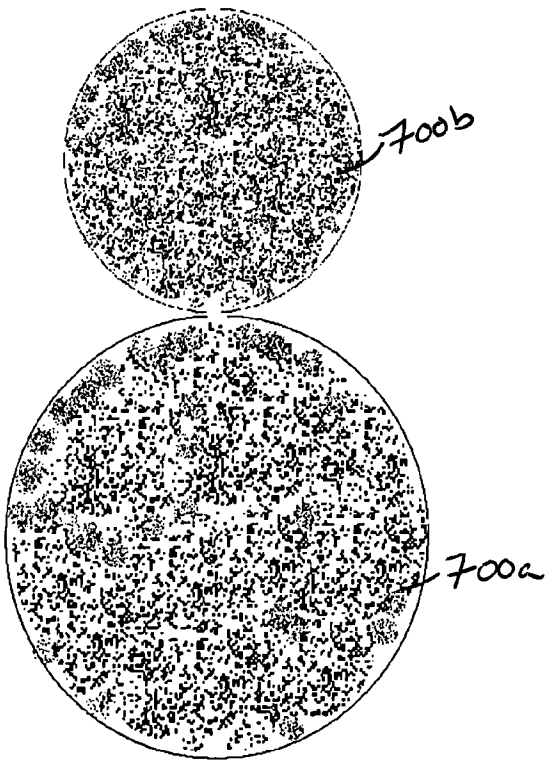

The invention further encompasses the compilation of the snow spheres together. FIG. 7*a* illustrates two snow spheres stacked on top of each other. FIG. 7*b* illustrates three spheres stacked on top of each other, namely the snow sphere trunk, torso and head 700 *a, b, c*, stacked on top of each other. Of course the invention encompasses the compilation of any number of snow spheres of the present invention.

FIG. 7*b* illustrates a further aspect of the invention, namely attachements. The attachements facilitate the building later of the appendages or features of the snow man/woman. In one aspect, the attachements comprise a receiving portion or socket 702, such as a depression or hole in the snow sphere and a mating stalk. In another aspect, there may be depressions 704 where facial or decorative features, such as buttons, may be stuck into.

Turning now in more detail to the atachements, they may be an armature attachment for a left or right arm 706 and may comprise several attachable or pre-attached parts. There may be, for example, a sleeve 708 for receiving another attachement. There may be, for example, joints, such as an elbow or wrist 710 *a,b*, respectively. The joints may be formed with pre-placed holes to receive corresponding appendages. There may also be a hand or hands, here shown in the shape of a mitten, 712 having a corresponding hole sized to mate with the wrist joint 710*b*.

Or the joints may comprise a ball bearing, hinged, or equivalent movable joint. With the moveable joint, the builder may pre-set the appendages in various positions, such as a hand wave. The joints may be lockable joints, such as a ratcheted joint. The details of joints and locking joints will not be discussed in detail as such technology is widely known.

The attachements may also comprise leg, or trunk stands 714. The trunk stand receiving portions, such as a stem or hole, are strategically place on the snow sphere in order to balance the trunk show sphere and the supporting load. The attachements may also include a stem for receiving the hat (or bonnet) of the snow man or woman. As shown in the figure, the attachements may also have a snow adhesive outer surface, similar in construction to the adhesive surface discussed above for the snow sphere.

In operation, the snow spheres are constructed and laden with snow. This may be done by applying a layer of snow, as discussed above, and then rolling the snow sphere in snow. This may also be achieved by patting on the snow. Or, the snow spheres may be prepared simply by rolling the snow spheres in snow and allowing the adhesive surface to collect the snow. The snow sphere are placed on top of each other. No problem because the spheres are much lighter than a normal snow boulder. Alternatively, the snow boulders may be placed on top of each other and then snow patted on. However, this is not so easy because the snow covered snow spheres balance better when placed on top of each other.

The snow doesn't collect in the holes where the attachments are to be placed, allowing the builder to insert the attachements into the snow sphere. Of course, the builder manually positions the snow sphere's in the correct orientation so that the left and right arms, hat attachement, etc are in the correct position. In the case where the invention includes the variant of the adjoinments, then the attachement holes are pre-placed in the corresponding positions relative to the adjoinments. In this latter case, the builder need not worry about the orientation since the adjoinment of the snow spheres will automatically align the attachements and associated holes or attachement points.

Figure 8A:
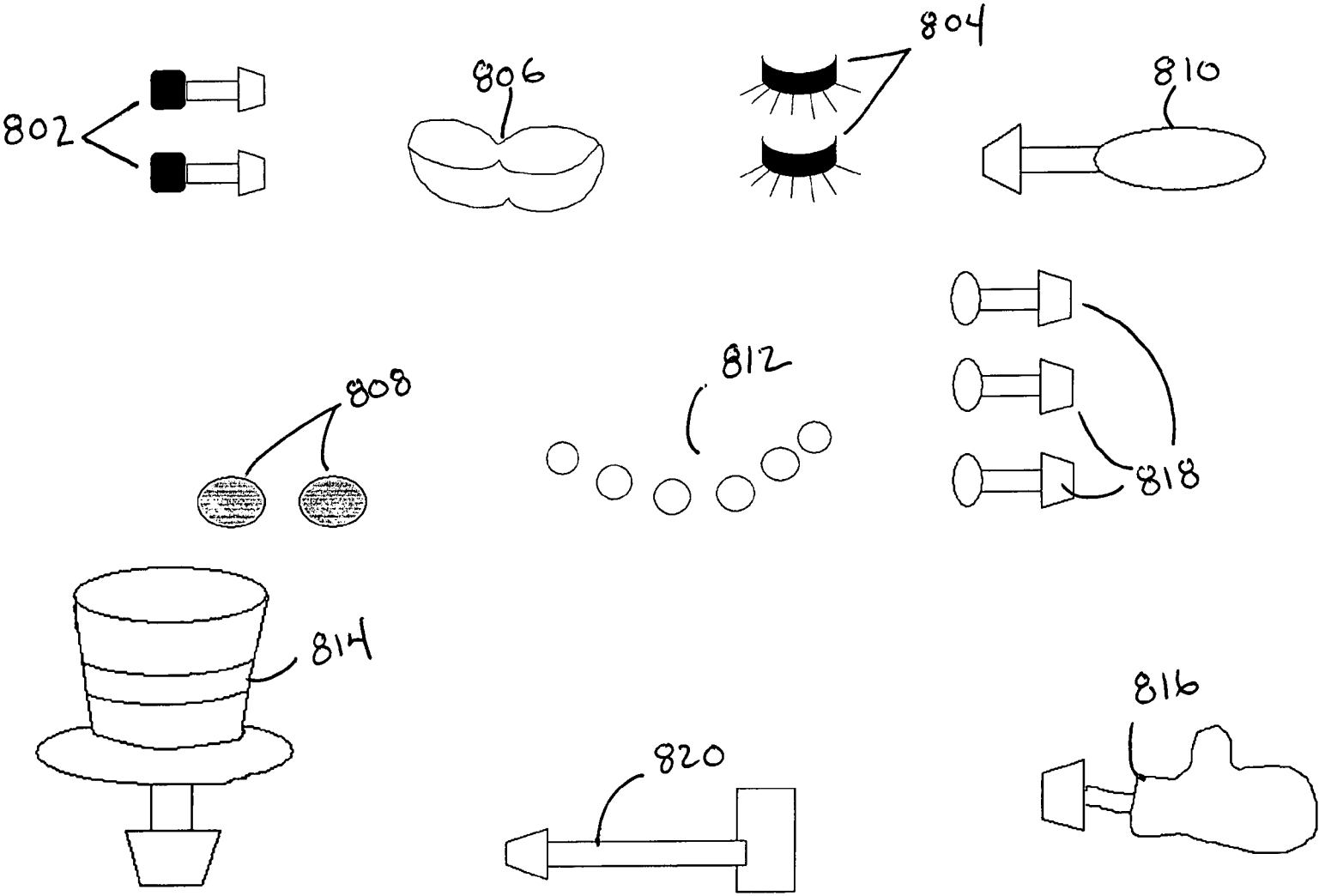
FIG. 8*a* illustrates attachments of the invention.
Figure 8B:
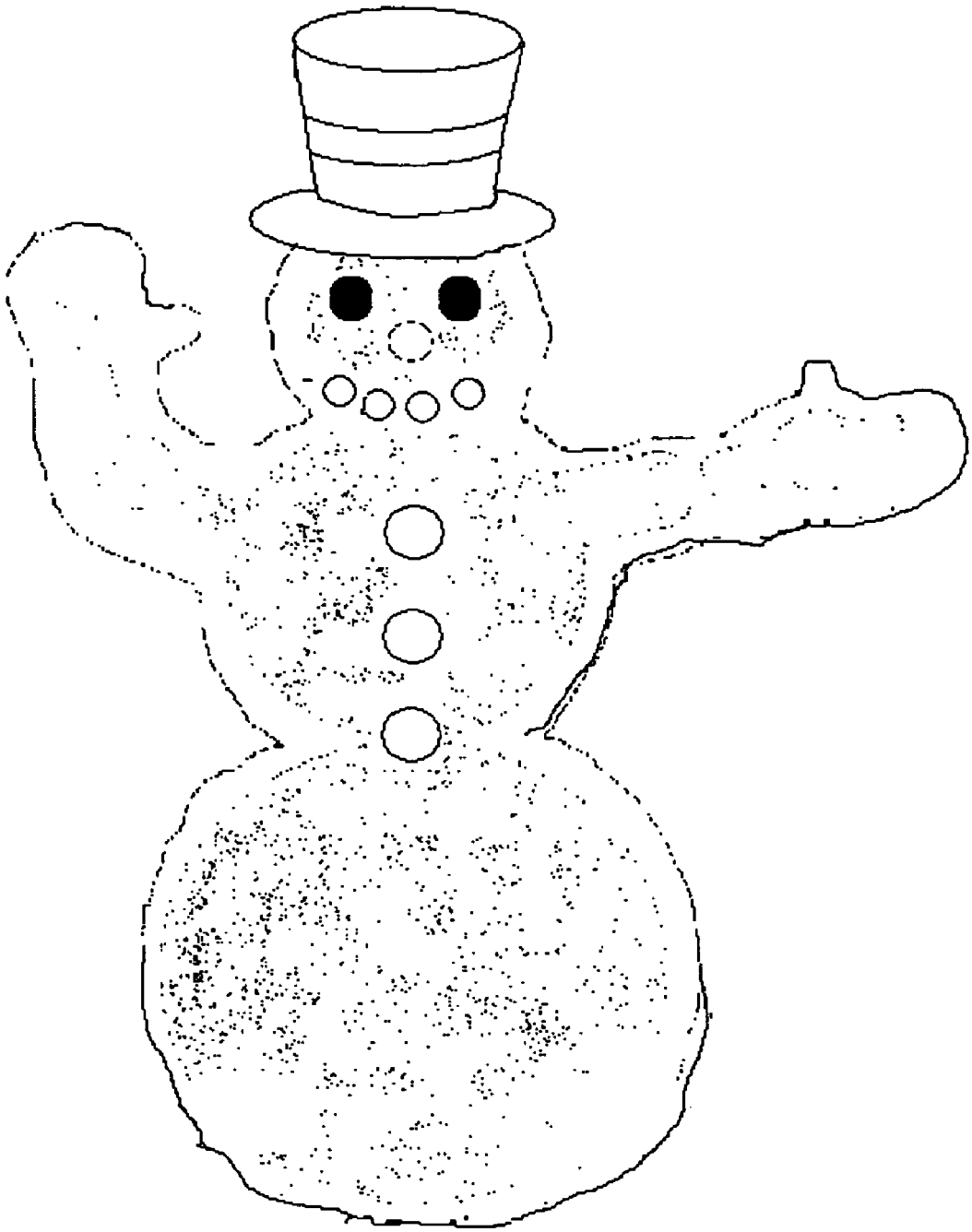
FIG. 8*b* illustrates a possible final product of the invention.

Turning now to FIGS. 8*a* and 8*b*, we come now to the accoutrement aspect of the invention. As mentioned above, wind and melting tend to alter the position of the features and decorations of the snow man/woman. Also, the quality of the snow effects the placement of such accoutrements. Cold snow has a poor friction coefficient, as compared with wetter or moister snow. Thus, the present invention provides accoutrements or accessories that include attaching mechanisms that allow the accessory to be firmly attached or inserted into the snow of the snow person and fixedly placed there.

As shown in FIG. 8*a*, there are various attachments. In one aspect, there are provided facial features, such as eyes 802, eye lashes 804, lips 806, rosy cheeks 808, nose 810 or mouth 812. Of course, not every variation of the attachments are shown. The eyes, here, are shown to be made out of black, coal brick-like, members. However, any type of eyes, including those with pupils, may be used. The lips may be in any form, not only together as shown here, but open, pursed, smiling, with teeth, etc.

The attachments may also be decorative or clothing. There is a top hat 814, mittens 816, buttons 818, or corn pipe 820. Of course, there may be other attachments, such as a scarf, or other adournment. Also, the attachments shown here are not the entire range or scope of the item shown. The hat may be a baseball or school boy cap, a bonnet, a wizard hat, a cowboy hat, a preacher hat, a fisherman's hat and on and on. The mittens may be instead a hand, a gloved hand, a baseball mit, etc. The buttons may be any shape or color. The pipe may be a cigarette, a lollipop stick, etc.

The attachments are provided with a manner in which to attach the accoutrement. Here, there is shown a stem attached to the accoutrement at the insertion end of the item. There may also be a barb, spade-shape or arrow-shaped spear head. The idea is that the graded side is inserted first into the snow and the blunt or orthogonal side faces the outer surface of the snow. The orthogonal side acts against the snow, making it more difficult to remove the inserted attachment. The spade is contemplated as the better of these options to prevent injury to children or adults. The attachment may be twisted, like a key in a lock, once inserted in order to align the orthogonal side with snow. There may, alternatively be provided a screw or cork-screw style attaching mechanism.

FIG. 8*b* illustrates the finished product. The ultimate snow man 822. The ultimate snow man is not to be defined by the adornments or appendages but, rather, chiefly defined by its shape. The symmetry of the snow spheres is a factor better than that can be achieved using the traditional snow person building style. More than that, the ultimate snow man/woman is more easily built, taking far less time than in the past. Of course, the attachments and arm appendages add to the superiority of the ultimate snow man/woman over the snow people of afore. Additionally, the size of the ultimate snow person can be made much larger than normal, owing to the ability to easily manipulate and heft the snow spheres.

The present invention also comprises a method of manufacture. Various manners in which to manufacture the invention are contemplated. In one variation, it is contemplated constructing a spherically-shaped body. The spherically-shaped body has an outer surface and an interior. The interior should be constructed to have a substantially lighter weight than when the interior is filled with snow. An adhesion surface is formed on the outer surface of the spherically-shaped body that substantially increases the ability of the outer surface to adhere snow to the spherically-shaped body, thereby forming the building block for facilitating the construction of the snow man/woman.

Figure 9:
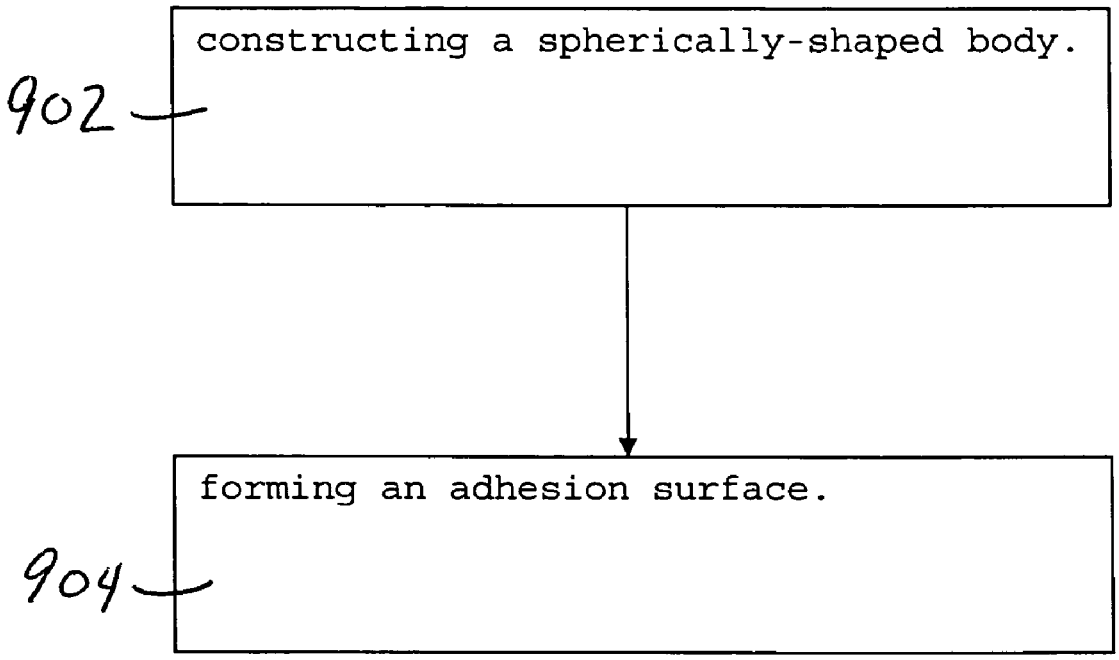
FIG. 9 is a flow diagram for manufacturing the invention.

The fundamental method 900 is shown in FIG. 9. In step 902, the spherically-shaped body is formed. Coinciding, or thereafter, the adhesion surface is formed on the outer surface of the spherically-shaped body in step 904.

The invention manufactures the snow sphere, in one concept, by using a mold. In one aspect, the spherically-shaped body and adhesion surface together are formed in the same mold. For example, this may be ideal for a snow sphere created from plastic, hard rubber, or some other mold amenable material.

The snow sphere may be formed in another manner. In the case that the snow sphere is made with holes or openings as the adhesion surface, the adhesion surface holes may be created by boring holes into the spherically-shaped body. In the case that a mold is used, the openings may be formed by including in the mold protrusions corresponding with the openings.

The invention also contemplates manufacturing different sizes of the spherically-shaped body for respective body members of the snow man/woman. In a variant, the invention provides packaging for sale at least two sizes of the spherically-shaped body corresponding to respective body members of the snow man/woman.

Figure 10A:
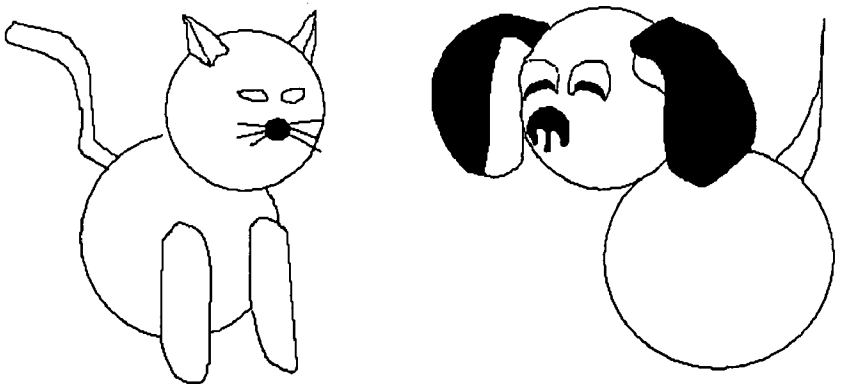
FIGS. 10*a* and 10*b* illustrates a variant on the caricatures of the invention.
Figure 10B:
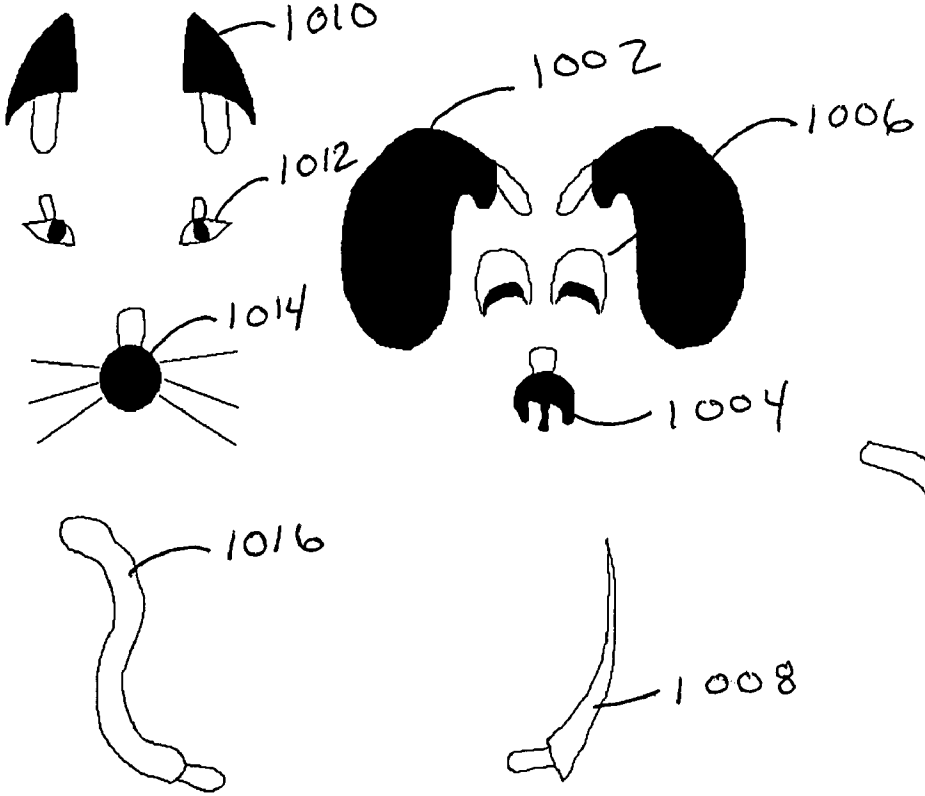

While the main invention envisions providing a snow sphere or spheres for a snow person, it should be bourn in mind that the invention also encompasses a snow humanoid. In the case, for example, that the person building the snow man wishes to build a snow monster, this should not matter to the invention. For that matter, the invention encompasses a snow animal, such as a cat 1000*a* or dog 1000*b* as shown in FIG. 10*a*, or an exotic animal, such as a giraffe or elephant, or any other animal for that matter. FIG. 10*b* illustrates attachments for the snow animal including doggie ears 1002, schnoz 1004, sappy eyes 1006 or waggy tail 1008. Alternatively, for the cat version, there may be provided cat ears 1010, Siamese eyes 1012, nose and whiskers 1014 or poofy tail 1016. Of course, these features may also be other than that shown.

The present invention has been described with reference to specific embodiments or variants. However, it shall be bourn in mind that modifications or variations to the present invention may be practiced that are still within the spirit and scope of the present invention.

The invention claimed is:

1. An apparatus forming a body part of a Snow man/woman, comprising:

a sphere that forms a circle about its x, y, z axes and is capable of being rolled in any direction, wherein the sphere is unitary, that is uncoupled from other pieces, wherein the sphere has an outer surface and an interior, the interior substantially lighter than when the interior is filled with snow;

an adhesion surface comprised of nodules provided continuously on the outer surface of the sphere that adheres snow and maintains the snow on its surface whilst being rolled; and wherein, when the sphere and adhesion surface are rolled on snow the adhesion surface attracts and adheres snow as the sphere is rolled over its complete exterior surface, thus forming thereon a layer of snow completely around the sphere that forms the body part of the Snow man/woman.

2. The apparatus of claim 1, further comprising that the snow building component is a body part of the Snow man/woman selected from the group consisting of a trunk, torso, or head.

3. The apparatus of claim 1, wherein the sphere is made of plastic.

4. The apparatus of claim 1, further comprising that the adhesion surface is comprised of nodules are trapezoidal in form.

5. The apparatus of claim 1, further comprising that the sphere is substantially hollow.

6. The apparatus of claim 1, further comprising at least one rib connecting at least two points along an interior surface of the sphere for providing additional structural support to the outer surface of the sphere.

7. The apparatus of claim 1, further comprising at least one spoke connecting at least two points along an interior surface of the sphere for providing additional structural support to the outer surface of the sphere.

8. The apparatus of claim 1, further comprising that an interior surface of the sphere comprises a light weight material as compared with compacted snow for providing additional structural support to the outer surface of the sphere.

9. The apparatus of claim 1, further comprising that the sphere is comprised of two separable hemispheres that, when brought together, form the sphere.

10. The apparatus of claim 1, further comprising an adjoinment that is connectably mounted to the building component for receiving another such building component.

11. The apparatus of claim 1, further comprising at least one attachment that is connectably mounted to the building component that forms a skeletal structure for an appendage of the Snow man/woman.

12. The apparatus of claim 1, further comprising at least one feature having fixing means for inserting the feature into the Snow man/woman, thereby fixing the feature to the Snow man/woman.

13. The apparatus of claim 12, further comprising that the feature is selected from the group consisting of: an eye, a nose and a mouth.

14. A method of providing a building component that forms a body part of a Snow man/woman, comprising the steps of:

providing a sphere that forms a circle about its x, y, z axes and is capable of being rolled in any direction, forming the sphere from a unitary work piece, that is uncoupled from other pieces, forming the sphere with an outer surface and an interior, the interior substantially lighter than when the interior is filled with snow;

forming an adhesion surface comprised of nodules continuously on the outer surface of the sphere that adheres snow and maintains the snow on its surface whilst being rolled; and wherein, when the sphere and adhesion surface are rolled on snow the adhesion surface attracts and adheres snow as the sphere is rolled over its complete exterior surface, thus forming thereon a layer of snow completely around the sphere that forms the body part of the Snow man/woman.

15. The method of claim 14, further comprising the step of manufacturing different sizes of the sphere for respective body members of the Snow man/woman.

16. The method of claim 14, further comprising the step of packaging for sale at least two sizes of the sphere corresponding to respective body members of the Snow man/woman.

17. The method of claim 14, further comprising the step of molding the sphere and adhesion surface together using a mold.

18. The method of claim 14, wherein the step of providing a sphere forms the sphere out of plastic.

19. The method of claim 14, further comprising the step of forming attachments corresponding to appendages of the Snow man/woman, the attachments separately formed from the sphere.

* * * * *